US006202536B1

(12) United States Patent
Harju

(10) Patent No.: US 6,202,536 B1
(45) Date of Patent: Mar. 20, 2001

(54) PNEUMATIC RECIPROCATORY ACTUATOR AND METHOD OF OPERATING IT

(75) Inventor: Bert Harju, Harads (SE)

(73) Assignee: Pos-Line AB, Harads (SE)

( * ) Notice: Subject to any disclaimer, the term of this patent is extended or adjusted under 35 U.S.C. 154(b) by 0 days.

(21) Appl. No.: 09/308,835

(22) PCT Filed: Nov. 25, 1997

(86) PCT No.: PCT/SE97/01977

§ 371 Date: Jul. 13, 1999

§ 102(e) Date: Jul. 13, 1999

(87) PCT Pub. No.: WO98/23865

PCT Pub. Date: Jun. 4, 1998

(30) Foreign Application Priority Data

Nov. 26, 1996 (SE) ..... 9604342

(51) Int. Cl.[7] ..... F15B 15/22
(52) U.S. Cl. ..... 91/464; 91/417 R
(58) Field of Search ..... 91/321, 405, 417 R, 91/462, 463, 464

(56) References Cited

U.S. PATENT DOCUMENTS 1,480,937 1/1924 Gottschalk .
2,593,412 * 4/1952 Chadwick et al. ..... 91/464 X
2,932,283 * 4/1960 Jeffery ..... 91/464 X
2,986,124 5/1961 Allemann .
3,012,541 12/1961 Meulendyk et al. .
3,068,849 * 12/1962 Thorner ..... 91/464 X
4,314,502 * 2/1982 Brinkel et al. ..... 91/464 X
4,367,673 * 1/1983 Krueck et al. ..... 91/464 X

FOREIGN PATENT DOCUMENTS 74116 8/1987 (FI) .

* cited by examiner

*Primary Examiner*—John E. Ryznic
(74) *Attorney, Agent, or Firm*—Larson & Taylor PLC

(57) ABSTRACT

In a pneumatic reciprocating actuator of the kind comprising a cylinder which defines a forward-motion chamber and a return-motion chamber, and a piston which is reciprocal in the cylinder and separates the forward-motion chamber and the return-motion chamber, a start stroke forwardly is initiated by admission of gaseous operating fluid from an inlet port in to the foreword-motion chamber with both the forward-motion chamber and the return-motion chamber initially at zero pressure. The operating fluid is also passed from the inlet port into the return-motion chamber during the start stroke until a back pressure of a predetermined magnitude has been produced in the return-motion chamber. Then the return-motion chamber is automatically closed by a pressure control valve unit, whereby the return-motion chamber will form a cushioning chamber for cushioning the movement of the piston in the forward direction, thereby preventing piston over speeding during the start stroke.

9 Claims, 3 Drawing Sheets

PNEUMATIC RECIPROCATORY ACTUATOR AND METHOD OF OPERATING IT

This invention relates to pneumatic actuators and, more particularly, to a reciprocatory actuator of the kind comprising a cylinder which defines two cylinder chambers separated by a piston which is reciprocable in the cylinder.

When operation of such actuators, also referred to as linear motors, is commenced, starting from an idle condition of the actuator with both cylinder chambers at zero pressure, a first or start stroke of the piston is initiated by admitting the operating fluid, i.e. air or other gaseous fluid, under pressure into one of the cylinder chambers. The piston then tends to move at excessive speed, because its movement is not impeded by a back pressure in the other cylinder chamber. A back pressure will be present to prevent the piston from overspeeding or moving at such excessive speed only after the first stroke of the piston has been completed.

To prevent such overspeeding of the piston it has been common practice to initiate the operation of the actuator at a reduced pressure of the operating fluid and raise the pressure to the normal working pressure only after completion of one or more operating cycles.

Operating the actuator in this manner is disadvantageous in several ways. For example, the initial stroke or strokes are normally ineffective, and initial operation of the actuator at a reduced pressure may be impracticable if a force corresponding to the normal operating pressure is required from the actuator during the first stroke. Moreover, a pressure regulator is required for changing the initial reduced operating pressure to the normal operating pressure, and it may be difficult to change the back pressure as desired to adapt it to changes in the load to be driven by the actuator.

In accordance with a first aspect of the present invention there is provided a method of operating a pneumatic reciprocatory actuator of the kind comprising a cylinder which defines a forward-motion chamber and a return-motion chamber, and a piston which is reciprocable in the cylinder and separates the forward-motion chamber and the return-motion chamber, in which a start stroke of the piston in a direction expanding the forward-motion chamber is initiated by admission of a gaseous operating fluid from an inlet port into the forward-motion chamber with both said chambers initially at substantially zero pressure, characterised by also admitting the operating fluid from the inlet port into the return-motion chamber during the start stroke until a back pressure of a predetermined magnitude has been produced in the return-motion chamber, and then closing the return-motion chamber, whereby the return-motion chamber will form a cushioning chamber for cushioning the movement of the piston and thereby preventing piston overspeeding during the start stroke.

In accordance-with a second aspect there is provided a pneumatic actuator comprising a cylinder having an inlet port for operating fluid and defining a forward-motion chamber and a return-motion chamber, a piston which is reciprocable in the cylinder and separates the forward-motion chamber and the return-motion chamber, and a valve device controlling flow of operating fluid into and out of the forward-motion chamber through a first fluid passage extending between the inlet port and the forward-motion chamber, characterised in-that the valve device includes a pressure control valve unit which is disposed in a second flow passage extending between the inlet port and the return-motion chamber and openable in response to the application to the inlet port of a predetermined first pressure to pass operating fluid from the inlet port to the return-motion chamber and closable in response to pressurisation of the return-motion chamber by a predetermined second pressure lower than the first pressure to block flow of operating fluid from the return-motion chamber.

Preferred embodiments of the method and the actuator according to the invention include features set forth in the dependent claims.

The invention is applicable to actuators for various uses, such as actuators for use in reciprocating work machines or machines for opening and closing doors, actuators for use as pneumatic springs, pneumatic shock absorbers, etc.

In accordance with the invention, overspeeding of the piston during the first or start stroke is effectively avoided even if the full operating pressure is immediately applied to the forward-motion chamber.

In accordance with the invention, the back pressure to be produced in the return-motion chamber can also be adjusted rapidly and by simple means to suit different loads such that a lower back pressure is produced for lighter loads and vice versa. If desired, the adjustment can be effected during operation of the actuator, e.g. automatically under control by a load-sensing device connected to an adjusting mechanism.

Further features and advantages of the invention will become apparent from the following detailed description of an embodiment of the actuator according to the invention.

Figure 1:
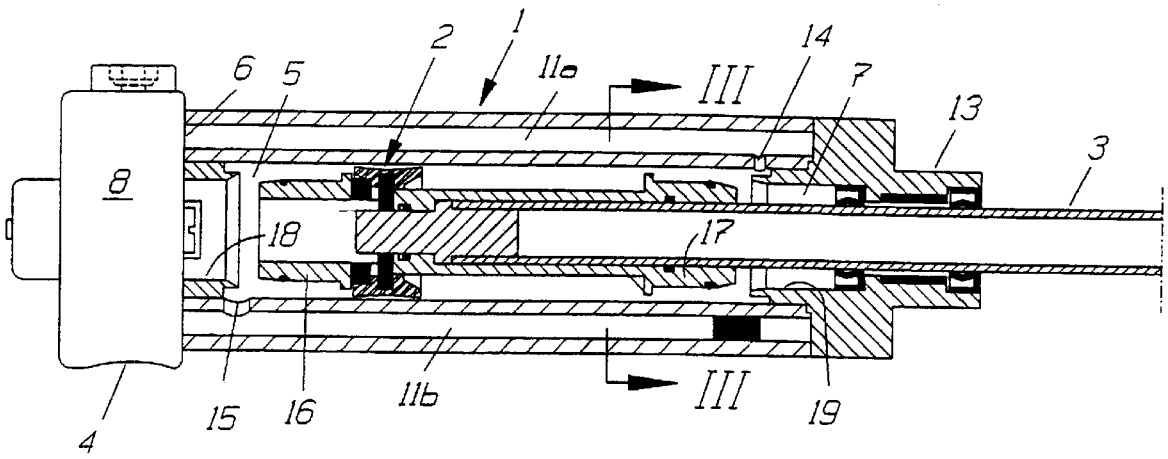
FIG. 1 is a side view, largely in longitudinal section, of a linear pneumatic actuator embodying the principles of the invention.
Figure 2:
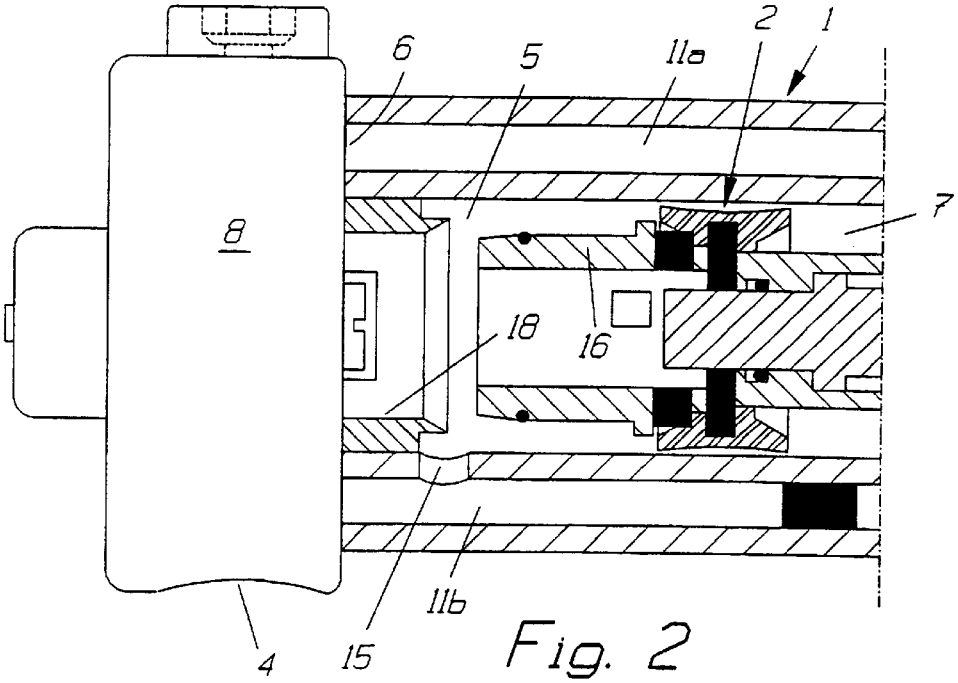
FIG. 2 shows the rear end portion of the actuator of FIG. 1 drawn to a larger scale.
Figure 4:
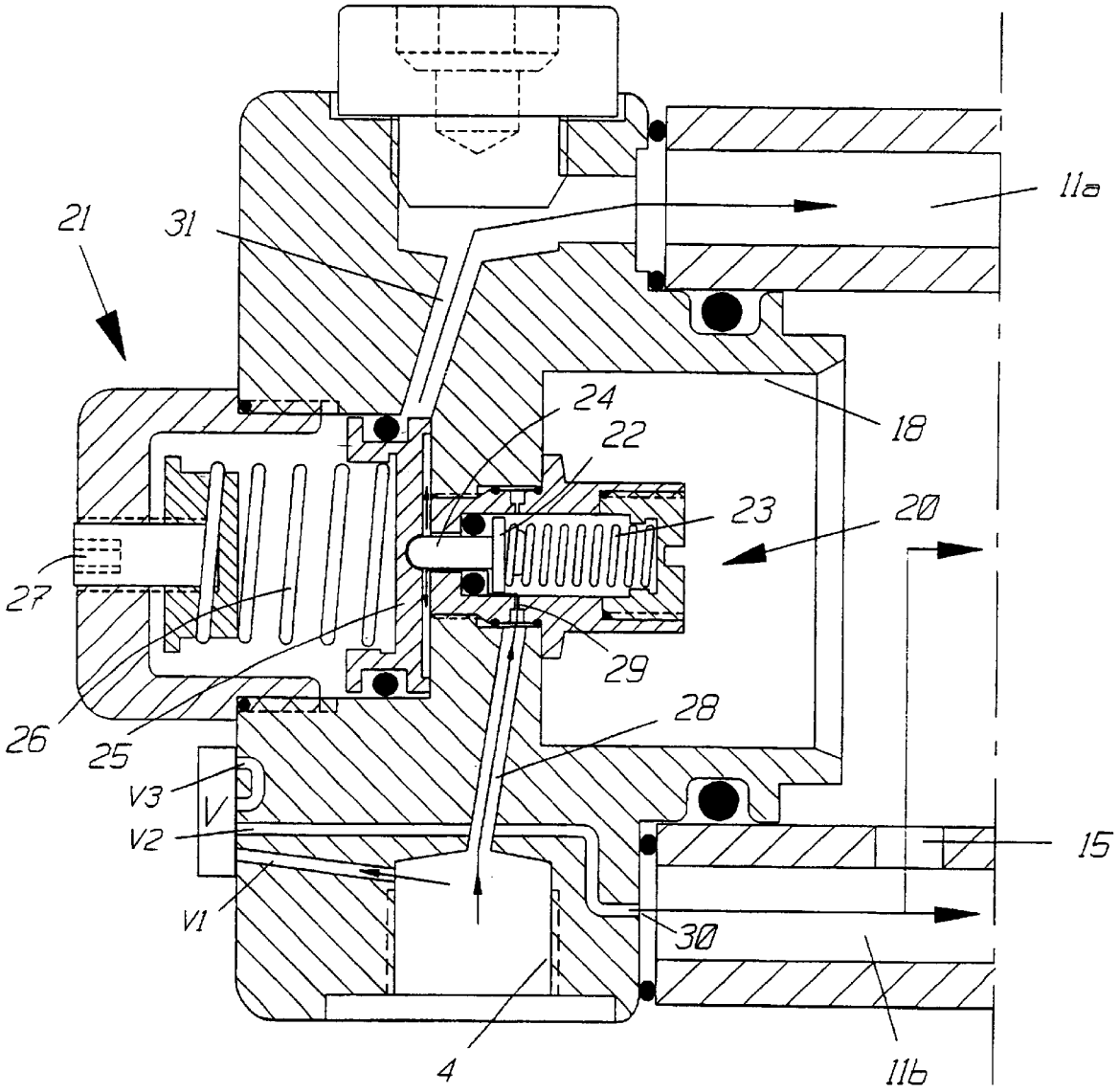
Figure 5:
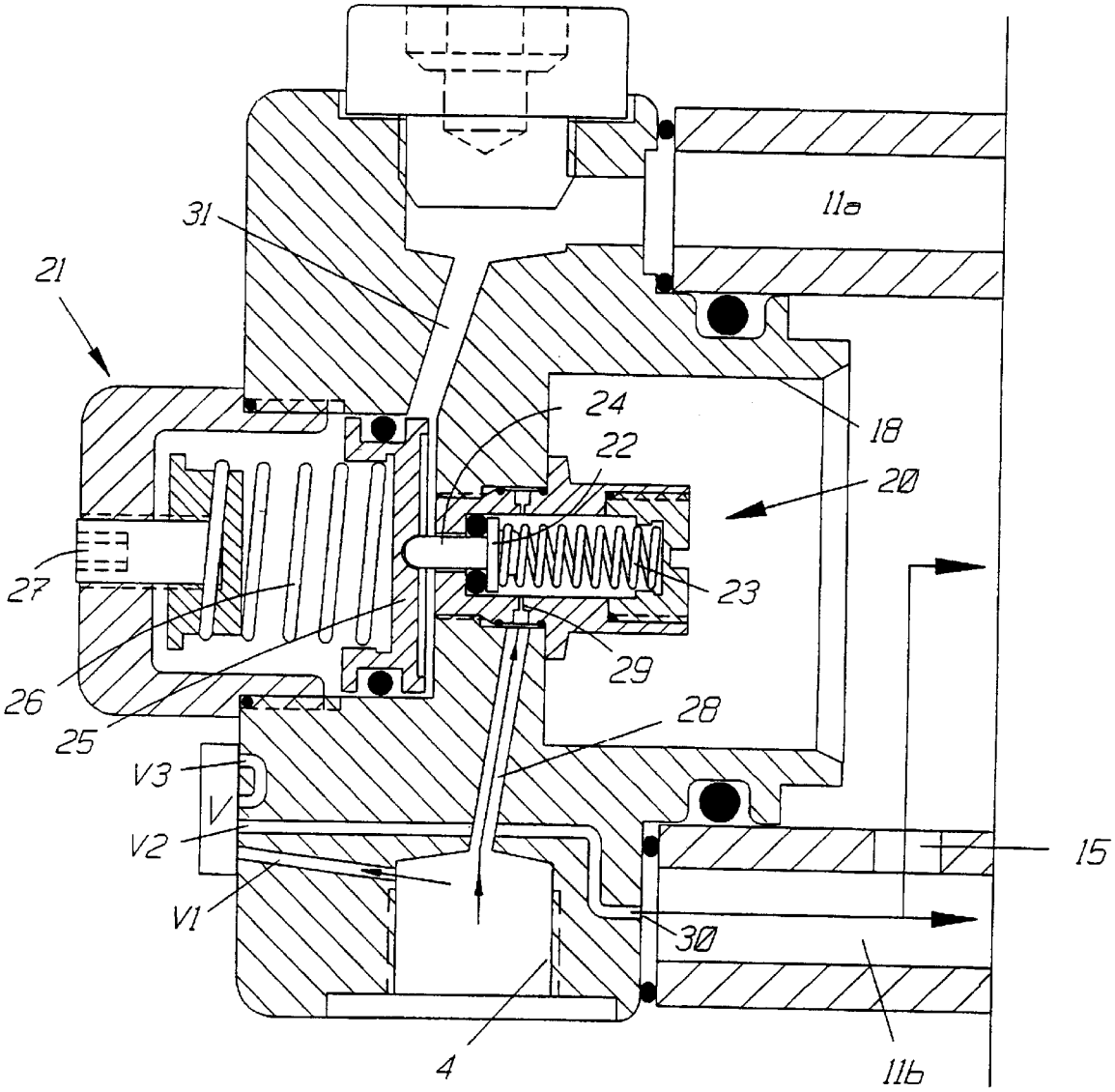

FIGS. 4 and 5 are enlarged longitudinal sectional views of the rear end portion of the actuator in FIG. 1 and show an automatic pressure control valve arrangement, FIG. 4 showing a phase of the start stroke of the operation of the actuator in which the operating fluid is being admitted into both cylinder chambers and FIG. 5 showing a subsequent phase of the start stroke in which the admission of the operating fluid into the return-motion chamber has been discontinued after the desired back pressure therein has been developed, while admission of the operating fluid into the forward-motion chamber continues.

The linear pneumatic actuator or motor shown in the drawings comprises a cylinder 1 and a piston 2 which is reciprocable in the cylinder and includes a piston rod 3, the end of which protrudes from the cylinder. A single port 4 for connecting a fluid line leading from a source of operating fluid, typically air, is provided in a rear cylinder head 8 at the rear end of the cylinder. From this port 4, operating fluid under pressure can be passed into into a first chamber 5, hereafter referred to as the forward-motion chamber, in the cylinder 1. A port 6 in constant open communication with a second cylinder chamber 7, hereafter referred to as the return-motion chamber, is also provided in the rear head 8. As shown in more detail in FIGS. 4 and 5, the cylinder head 8 houses a pressure control valve unit, which will be described below.

Figure 3:
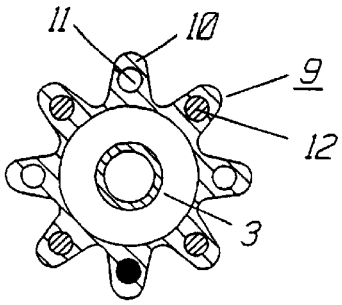
FIG. 3 is a cross-sectional view on line III—III of FIG. 1.

As shown in FIG. 3 the wall 9 of the cylinder 1 is star-shaped with eight star points 10, all of which are formed with elongate passages in the shape of axial holes 11 extending throughout the length of the cylinder. Four of the holes are used for the reception of tie rods 12, and one or more 11*a* of the remaining holes may be used for conveying compressed air, especially in the type of cylinder in which there is only a single connection for a source of compressed air. A front cylinder head 13 at the right-hand end of the cylinder 1 has a through bore for the piston rod 3. Adjacent that cylinder head 13 an aperture 14 interconnects the return-motion chamber 7 of the cylinder 1 with the uppermost one 11*a* of the axial holes 11. A similar aperture 15 adjacent the left-hand or rear cylinder head 8 interconnects the forward-motion chamber 5 with the lowermost one 11*b* of the axial holes 11. The axial hole 11*b,* which is plugged adjacent the front cylinder head 13, forms an extension of the forward-motion chamber 5 to increase the total volume thereof.

Opposite sides of the piston 2 are provided with an extension forming a damping piston 16, 17. Each damping piston cooperates with a respective damping cylinder 18, 19 at opposite ends of the cylinder 1. The damping piston/cylinder devices 16, 18 and 17, 19 serve to cushion the strokes of the piston 2 adjacent the cylinder ends.

The above-mentioned pressure control valve unit comprises two cooperating valves 20 and 21 which control the flow of operating fluid under pressure from the port 4 into the return-motion chamber 7. The valve 20 serves to isolate the return-motion chamber 7 from the full pressure of the operating fluid once the predetermined back pressure has been reached in that chamber, and the valve 21 serves to admit operating fluid into the return-motion chamber 7 until that back pressure has been reached.

A valve compartment in the valve 20 accommodates a valve member 22 which is urged in the direction of the valve 21 by a compression spring 23 and thereby biassed towards a closed position in engagement with an associated valve seat in the form of an annular seal. A spigot 24 on one side of the valve member 22 extends into a valve chamber of the valve 21 in which a valve member 25 is accommodated and urged in the direction of the valve 20 by a compression spring 26 and thereby biassed towards an associated valve seat formed by a wall of the valve chamber. The biassing force of the spring 26 can be set by turning an adjusting screw 27 belonging to the valve 21.

A flow passage 28 for operating fluid extends from the port 4 and opens into the valve compartment in the valve 20 through a restricted orifice 29. Extending from the port 4 is also a flow passage V1 which opens into a two-position directional control valve V. In a first position thereof, the valve V passes operating fluid from the flow passage V1 into a further flow passage V2 and through a port 30 opening into the lowermost axial hole 11*b,* from which the operating fluid passes into the forward-motion chamber 5 through the aperture 15. In a second position thereof, the valve V interconnects the flow passage V2 with a flow passage V3 to discharge operating fluid from the forward-motion chamber 5 and the hole 11*b*.

Naturally, the just-described arrangement comprising the three-way, two-position valve V and the associated flow passages V1, V2 and V3 only is an illustrative example of means and ways of pressurising the forward-motion chamber 5.

The diameter of the disc-like valve member 22 of the valve 20 is smaller than the diameter of the valve compartment accommodating it. In the open position of the valve member 22 shown in FIG. 4, air entering the valve compartment can therefore flow past the valve member 22 through the associated annular valve seat and then through an annular gap around the spigot 24. The spigot 24 is of such a length that when the valve member 25 of the valve 21 is in the closed position shown in FIG. 4, it bears against the end of the spigot to keep the valve member 22 in the open position.

A flow passage 31 connects the valve chamber of the valve 21 with the axial cylinder passage 11*a* and thereby with the return-motion chamber 7 through the aperture 14 such that the return-motion chamber 7 is always in open communication with the valve chamber.

The operation of the actuator shown in the drawings is as follows.

FIG. 4 shows a situation in which a start stroke, i.e. a forward stroke of a first cycle of repetitive operation of the actuator, has been initiated by opening the supply of pressurised operating fluid to the port 4 with the valve V in its first position and both cylinder chambers 5 and 7 initially at zero or very low pressure.

Operating fluid flows from the port 4 through the passages V1 and V2 into the axial passage 11*b* and through the aperture 15 into the forward-motion chamber 5 as indicated by arrows. At the same time, operating fluid flows through the passage 28 into the second valve 20 and past the second valve member 22 to the front face of the valve member 25 of the first valve 21. Initially, the pressure of the operating fluid is sufficient to overcome the bias of the spring 26 and displace the valve member 25 slightly from the associated valve seat so that operating fluid can flow past the valve member 25 and through the passage 31 and the axial cylinder passage 11*a* as indicated by an arrow and into the return-motion chamber 7.

Accordingly, both the forward-motion chamber 5 and the return-motion chamber 7 will be pressurised, although the back pressure thus produced in the return-motion chamber 7 by the admission of operating fluid through the valves 20 and 21 will be limited to a value substantially lower than the maximum pressure produced in the forward-motion chamber in normal operation of the actuator, such as, for example, 10–20 percent of that pressure. For example, with a maximum operating fluid pressure in the forward-motion chamber of 7–10 bar, the admission of operating-fluid past the valves 20 and 21 may be discontinued when the back pressure in the return-motion chamber 7 reaches a desired value in the range of 1–3 bar.

The maximum back pressure that can be produced in the return-motion chamber 7 is determined by the valve 21, namely by the setting of the adjusting screw 27 and thus the biassing force applied to the valve member 25 by the spring 26. When the back pressure reaches the desired set magnitude, the pressure acting on the front face of the second valve member 25 will cause the valve member 25 to move away from its associated seat sufficiently to allow the biassing spring 23 of the valve 20 to move the second valve member 22 into sealing engagement with its associated valve seat. The pressure of the operating fluid in the valve compartment of the valve 20 acting on the valve member 22 will then keep that valve member firmly engaged with its seat so that the operating fluid trapped downstream of the valve 20 cannot escape.

The back pressure produced in the return-motion chamber 7 by the trapped volume of operating fluid will act in opposition to the pressure in the forward-motion chamber 5 which displaces the piston 2 forwardly through a power stroke to extend the piston rod 3. The back pressure thus will prevent the piston from overspeeding under the action of the pressure in the forward-motion chamber 5.

When the valve V is then placed in its second position to discharge operating fluid from the forward-motion chamber 5, the trapped volume of operating fluid in the return-motion chamber 7 will expand and displace the piston 2 through a backward or return stroke to retract the piston rod 3. When the valve V is then returned to the first position to initiate a new forward power stroke, the back pressure already exists so that it need not be produced again. Thus, once the back pressure in the return-motion chamber has been built up to the desired set level, the valve 20 normally remains closed to isolate that chamber from the port 4.

If for one reason or other the back pressure in the return-motion chamber 7 should fall below the desired set pressure, or if the setting of the back pressure is raised by means of the adjusting screw 27, the biassing spring 26 will displace the valve member 26 towards the associated seat to cause the valve member 22 of the second valve 20 to open again and admit additional operating fluid through the valves 20 and 21 until the back pressure is again at the desired set value and the first valve 21 recloses.

It may be desirable to adjust the maximum back pressure if the load being moved by the actuator is changed so that the back pressure will be adapted to the load. Such adjustment can be effected rapidly and in a simple manner, even during operation of the actuator: to reduce the maximum back pressure the adjusting screw 27 is turned outwardly to reduce the biassing force applied by the biassing spring 26, and vice versa. By suitable adjustment of the back pressure, optimum operation of the actuator can be achieved, and in use of the actuator for closing and opening doors, as air spring suspensions for vehicles and in several other applications, the operating and back pressures can be readily adjusted for maximum safety and comfort.

The valve V or any other valve used for controlling the admission of operating fluid into the forward-motion chamber 5 suitably is arranged such that the forward piston motion is reversed when the piston 2 has traversed a predetermined distance in the cylinder.

What is claimed is:

1. A method of operating a pneumatic reciprocatory actuator (1–3) of the kind comprising a cylinder (1) which defines a forward-motion chamber (5) and a return-motion chamber (7), and a piston (2) which is reciprocable in the cylinder (1) and separates the forward-motion chamber (5) and the return-motion chamber (7), in which a start stroke in a direction to expand the forward-motion chamber is initiated by admission of a gaseous operating fluid from an inlet port (4) into the forward-motion chamber with both the forward-motion chamber (5) and the return-motion chamber (7) initially at substantially zero pressure, characterised by also admitting the operating fluid from the inlet port (4) into the return-motion chamber (7) during the start stroke until a back pressure of a predetermined magnitude has been produced in the return-motion chamber (7), and then closing the return-motion chamber (7), whereby the return-motion chamber (7) will form a cushioning chamber for cushioning the movement of the piston (2), thereby preventing piston overspeeding during the start stroke, the admission of the operating fluid from the inlet port (4) into the return-motion chamber (7) being effected through a pressure control valve device (20, 21) adapted to close a flow passage (28, 29, 31) between the inlet port (4) and the return-motion chamber (7) in response to the pressure in the return-motion chamber (7) reaching the predetermined magnitude.

2. A method according to claim 1, characterised by venting the forward-motion chamber (5) upon completion of the start stroke while maintaining the closed condition of the return-motion chamber (7), whereby the return-motion chamber (7) is allowed to expand.

3. A pneumatic actuator comprising a cylinder (1) having an inlet port (4) for operating fluid and defining a forward-motion chamber (5) and a return-motion chamber (7), a piston (2) which is reciprocable in the cylinder and separates the forward-motion chamber (5) and the return-motion chamber (7), and a valve device (V, 20, 21) controlling flow of operating fluid into and out of the forward-motion chamber (5) through a first fluid passage (V1,V2) extending between the inlet port (4) and the forward-motion chamber, characterised in that the valve device (V, 20, 21) includes a pressure control valve unit (20, 21) which is disposed in a second flow passage (28,29,31) extending between the inlet port (4) and the return-motion chamber (7) and openable in response to the application to the inlet port (4) of a predetermined first pressure to pass operating fluid from the inlet port (4) to the return-motion chamber and closable in response to pressurisation of the return-motion chamber (7) by a predetermined second pressure lower than the first pressure to block flow of operating fluid from the return-motion chamber (7), and in that the pressure control valve unit (21, 20) includes a first valve (21) having a first valve member (25), a first valve seat associated therewith, and a spring (26) biassing the first valve member (25) to a closed position in sealing engagement with the second valve seat, said first valve member (25) being displaceable by said predetermined first pressure to an open position against the spring bias, a second valve (20) including a second valve member (22), a second valve seat associated therewith, and a spring (23) biassing the second valve member (22) to a closed position in sealing engagement with the second valve seat, and a valve operating member (24) for keeping the second valve member (22) in an open position by means of the first valve member (26) when the first valve member is in the closed position and allowing the second valve member (22) to move to the closed position in response to the first valve member (25) becoming displaced to the open position.

4. A pneumatic actuator according to claim 3, in which the valve operating member (24) comprises a push rod positioned between the first and second valve members (25, 22) and in which the first and second springs (26, 23) bias the valve members in opposite directions.

5. A pneumatic actuator according claim 3, in which the pressure control valve unit (21, 20) includes a valve adjusting device (27) for varying the first pressure.

6. A pneumatic actuator according to claim 5 when dependent on claim 4, in which the valve adjusting device comprises an adjusting screw (27) for varying the bias of the first spring (26).

7. A pneumatic actuator according to claim 3 in which the piston is provided with a piston rod (3) protruding from one end of the cylinder (1) and the opposite end of the cylinder is provided with a cylinder head (8), and in which the pressure control valve (21, 20) unit is incorporated in the cylinder head (8).

8. A pneumatic actuator according to claim 8 having a single inlet port (4) for operating fluid, in which the inlet port (4) is provided in the cylinder head (8) and the wall of the cylinder (1) is provided with an axially extending passage **(11*a*) communicating with the second flow passage (28, 29, 31) and the return-motion chamber (7)**.

9. A pneumatic actuator according to claim 3 in which the wall of the cylinder (1) is provided with at least one axially extending passage **(11*b*) communicating with the inlet port (4) and the forward-motion chamber (5)**.

* * * * *